US006488034B1

(12) United States Patent
Blazek

(10) Patent No.: US 6,488,034 B1
(45) **Date of Patent: *Dec. 3, 2002**

(54) FILE, PARTICULARLY NAIL FILE

(76) Inventor: Dalibor Blazek, Olbrachtova 600/II, 290 01 Podebrady (CZ)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/254,578

(22) PCT Filed: Jul. 9, 1998

(86) PCT No.: PCT/CZ98/00030

§ 371 (c)(1),
(2), (4) Date: Apr. 14, 1999

(87) PCT Pub. No.: WO99/02064

PCT Pub. Date: Jan. 21, 1999

(30) Foreign Application Priority Data

Jul. 10, 1997 (CZ) ..... PUV693697

(51) Int. Cl.[7] ..... A45D 29/18
(52) U.S. Cl. ..... 132/76.4; 132/76.5
(58) Field of Search ..... 132/76.4, 76.5; 451/28, 59, 533, 539, 525

(56) References Cited

U.S. PATENT DOCUMENTS

| | | | | | |
|---|---|---|---|---|---|
| 1,907,196 | A | | 5/1933 | Aitken | |
| 2,308,624 | A | | 1/1943 | Pouech | 132/76.4 |
| 2,699,791 | A | | 1/1955 | Hansen | 132/76.4 |
| 3,648,318 | A | * | 3/1972 | Tsuruzawa | 451/533 |
| 3,866,618 | A | * | 2/1975 | Tsukamoto | 132/76.4 |
| 4,422,465 | A | | 12/1983 | Haga | 132/76.4 |
| 4,497,694 | A | * | 2/1985 | Bankier et al. | 204/16 |
| 4,785,835 | A | * | 11/1988 | Bray | 132/76.4 |
| 5,119,839 | A | * | 6/1992 | Rudolph | 132/200 |
| 5,361,786 | A | | 11/1994 | Pangburn | 132/200 |
| 5,779,519 | A | * | 7/1998 | Oliver | 451/28 |
| 5,813,416 | A | * | 9/1998 | Rudolph | 132/76.4 |
| 6,012,461 | A | * | 2/2000 | McKew | 132/73 |
| 6,027,402 | A | * | 2/2000 | Oliver | 451/533 |
| 6,145,512 | A | * | 11/2000 | Daley | 132/76.4 |

FOREIGN PATENT DOCUMENTS

| | | |
|---|---|---|
| CA | 2142949 | 7/1996 |
| DE | 18 21 813 | 11/1960 |
| DE | 19 71 152 | 10/1967 |
| ES | 8505511 | 9/1985 |

* cited by examiner

*Primary Examiner*—Nicholas D. Lucchesi
*Assistant Examiner*—Robyn Kieu Doan
(74) *Attorney, Agent, or Firm*—Merchant & Gould P.C.

(57) ABSTRACT

The file, the body of which is provided on at least part of its surface with a roughness varying from 10 to 100 $\mu$m, is made of flat, pressed or hardened glass. The file can have a variety of geometrical shapes and cross sections.

20 Claims, 1 Drawing Sheet

FILE, PARTICULARLY NAIL FILE

FIELD OF THE INVENTION

The invention involves a file, particularly for nails, manufactured from glass.

DESCRIPTION OF THE PRIOR ART

Nail files, which are among the principal components of the various sets of cosmetic equipment, are at the present time manufactured from various metals or their alloys, from paper or fabric with a rough finish, as the case may be. Since files destined for such purposes are often used in an environment with high humidity, for example during personal hygiene in the bathroom, it happens in some cases that they corrode or the material from which the file is made becomes moist resulting, on the one band, in a deterioration in appearance and, on the other, a dulling of the cutting edges of the file from the effects of corrosion and humidity and, thereby, a basic loss of effectiveness. If non-corrosive materials are used in the manufacture of files, which is generally the case, then the disadvantage is the high price. The disadvantage of metal files in which the cutting edges are formed by mechanical means is also the limited "smoothness" of the file, and the fact that by mechanical means it is possible to produce only a limited degree of roughness of the abrasive surface. Likewise, it is simply not possible to produce a series of files with finely graded roughness. It is convenient, in the use of a file, that the side edges be functional, that is rough. Because metal files are flat and too thin, it is not practical to use their side edges to trim the nails.

SUMMARY OF THE INVENTION

The above disadvantages are eyed in the file according to the invention presented here, the basis of which lies in the fact that it is made from glass roughened on at least part of its surface, with a roughness varying from 10 to 100 $\mu$m.

The advantage of such a file is its absolute resistance to the environment in which it is used It is significant too that, given its non-corrosive properties, the abrasive surfaces can be kept clean by rinsing in water.

It is important to note here the wide range of surface roughness that can be attained, varying from the smoothest finish with a roughness of 10 $\mu$m to a roughness of around 100 $\mu$m.

The glass body of the file has an oblong board shape and has a point at one end at least. The advantage of such a shape for the glass body of the file is the ease of manipulation in use and, thanks to the point, its practical value for hand hygiene is increased.

Another advantageous solution to be noted is the fact that the glass body of the file is roughened along one whole side at least, having a V-shaped point at the end. The advantages of such a file are apparent both during use of the file and during its manufacture, when roughening of the whole surface is carried out without the need, for instant to mask part of the He during the roughening process by use of acid engraving for example. The point is formed in a V shape, its symmetrical shape facilitating manipulation during use of the file in either the left or the right hand.

A further advantageous feature is the fact that body of the file is roughened along one whole side at least and is ground to a sharp finish on at least one edge. The longitudinald edge formed on one side of the body of the file further increases the functional possibilities of the nail file.

It is possible to form the body of the file so that both edges are bevelled, while the bevelled edge at the end is at an oblique angle to the side edge, so that together they form a point. This variation further increases the wide range of uses for the file.

Another advantageous arrangement for do shape of the body of the file, consisting in the fact that the surface of at least one of the edges and of one end of the body of the file is also roughened, further contributes to increasing its usefulness.

To further improve performance, the edges of the body of the file are rounded. These variations in the shape of the glass file further extend its usefulness for special cases of hand hygiene.

From the point of view of production technology, it is an advantage if the body of the file can be formed from flat or pressed glass.

All the various shapes of the file can have a glass body formed from hardened glass. The advantages of such a treated glass body are its increased stability and particularly increased safety in the event of breakage of the whole of the glass body by dropping etc. The hardening of the glass-bodied file gives it properties which are well-known in such treated glass.

BRIEF DESCRIPTION OF THE DRAWINGS

The invention can be better described by means of the drawings, of which

DESCRIPTION OF THE PREFERRED EMBODIMENTS

Figure 1:
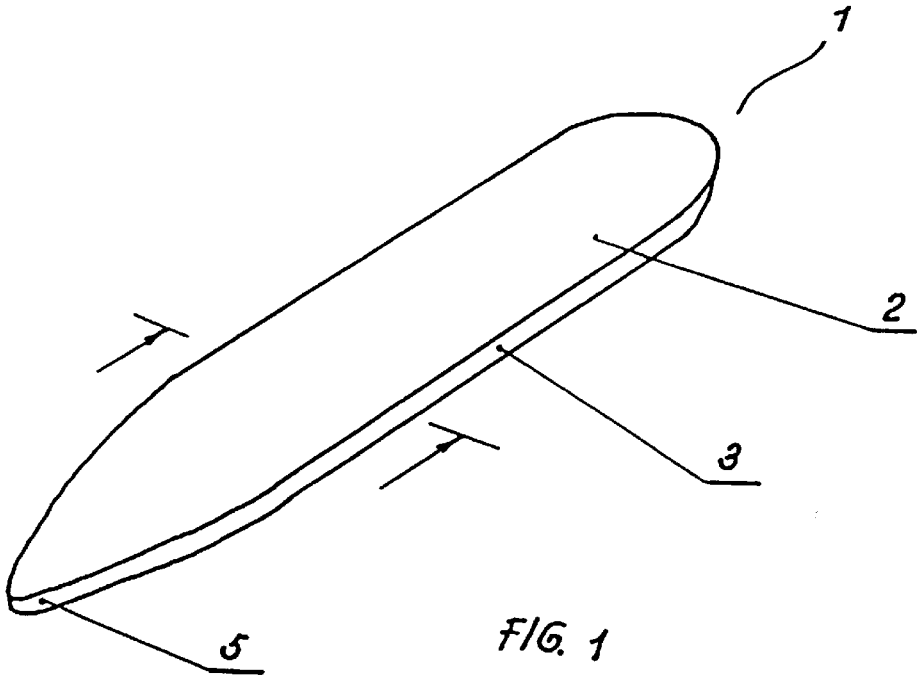
FIG. 1 represents an axonometric overview of the glass body of the file.
Figure 2:
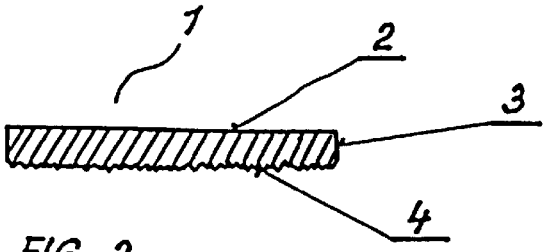
FIG. 2 presents a cross section of the glass body of the file with roughening on one surface.

The file according to FIG. 1 is formed from a glass body 1, shown here in oblong board shape,with a roughening 4 on the surface 2. The roughening 4 is produced by a wide variety of techniques, the choice depending upon the degree of roughness. To produce the smoothest finish, for example around 10 $\mu$m, a chemical process can be used, such as acid engraving with a hydrogen fluoride solution. Greater roughness, of around 100 $\mu$m for instance, can be produced mechanically, by sanding for example. FIG. 2 shows a cross section of the glass body 1 of the file illustrated in FIG. 1, with a roughened finish 4 along the whole of one surface 2.

Figure 3:
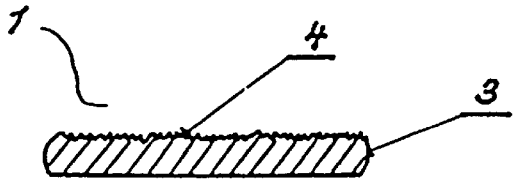
FIG. 3 also shows a cross section of the glass body of the file with roughening on one side and rounded edges. Similarly.
Figure 4:
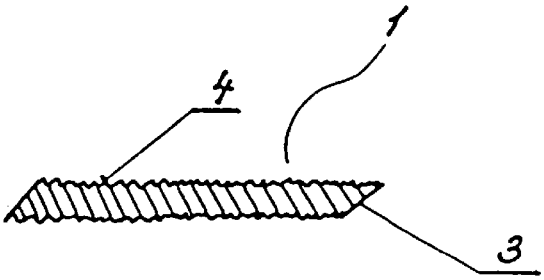
FIG. 4 presents a cross section of the glass body of the file, both of whose edges are bevelled.

FIGS. 3 and 4 illustrate further possible variants on the glass body 1 of the oblong board-shaped file. A cross section is shown of the glass body 1 of the file, with roughening 4 of one surface finish 2, the glass body 1 of the file having rounded edges 3, while the cross section in FIG. 4 presents the glass body 1 of the file with edges 3 bevelled to a sharp finish, the glass body 1 of the file having a rough finish 4 on both surfaces 2.

INDUSTRIAL USE OF THE INVENTION

The glass-bodied file has been described from the point of view of its use as a nail file. This example of use, however, in no way excludes further possible uses in other fields, particularly given the wide range of roughness which can be achieved in the glass-bodied file. A file produced according to this invention with a low degree of roughness, that is to say the finest, can be used in polishing surfaces, for example, while the coarsest can be used for grinding.

What is claimed is:

1. A nail file, comprising a body, said body comprising first and second sides, first and second edges, a first end, and at least one abrading surface, said abrading surface comprising an irregular texture having a roughness that varies from about 10 $\mu$m to about 100 $\mu$m, wherein said body, first and second sides, first and second edges, first end, and said at least one abrading surface are formed of a single, integral stratum, said integral stratum comprising glass.

2. A file according to claim 1, wherein said body has an oblong shape, and wherein said first end is in the shape of a point.

3. A file according to claim 1, wherein said at least one abrading surface is disposed on all of the first side.

4. A file according to claim 1, wherein at least one of said first and second edges is bevelled to a sharp finish.

5. A file according to claim 1, wherein both of said first and second edges and said first end are bevelled, such that said edges and said first end form said point.

6. A file according to claim 1, wherein said at least one abrading surface is disposed on at least a portion of said first edge.

7. A file according to claim 1, wherein at least one of said first and second edges is rounded.

8. A file according to claim 1, wherein said integral stratum comprises flat glass.

9. A file according to claim 1, wherein said integral stratum comprised pressed glass.

10. A file according to claim 1, wherein said integral stratum comprises hardened glass.

11. A file according to claim 2, wherein said point is V-shaped.

12. A file according to claim 1, wherein said at least one abrading surface is disposed on a portion of said first side.

13. A file according to claim 1, wherein said at least one abrading surface is disposed on all of said second side.

14. A file according to claim 1, wherein said at least one abrading surface is disposed on a portion of said second side.

15. A file according to claim 1, wherein said at least one abrading surface is disposed on at least a portion of said second edge.

16. A file according to claim 1, wherein said at least one abrading surface is disposed on at least a portion of said first end.

17. A file according to claim 1, comprising a plurality of abrading surfaces.

18. A nail file according to claim 1, wherein said glass comprises hardened glass.

19. A method for making a nail file, comprising the steps of:

roughening a body comprising a single, integral stratum of glass so as to produce at least one abrading surface having an irregular texture with a roughness that varies from about 10 $\mu$m to about 100 $\mu$m, said roughening comprising at least one operation selected from the group consisting of acid-etching and sanding; and hardening the glass body.

20. A method according to claim 19, wherein said roughening is performed without masking said glass body.

* * * * *

UNITED STATES PATENT AND TRADEMARK OFFICE

CERTIFICATE OF CORRECTION

PATENT NO. : 6,488,034 B1
DATED : December 3, 2002
INVENTOR(S) : Blazek

It is certified that error appears in the above-identified patent and that said Letters Patent is hereby corrected as shown below:

Title page,
Item [56], References Cited, U.S. PATENT DOCUMENTS, insert
-- 5,036,731 8/1991 Fletcher --
FOREIGN PATENT DOCUMENTS, insert
-- CH 237277 11/1943

Column 1,
Line 18, “band” should read -- hand --
Line 59, “He during” should read -- surface during --
Line 65, “longitudinald” should read -- longitudinal --

Signed and Sealed this

Twenty-fourth Day of June, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,488,034 B1
DATED : December 3, 2002
INVENTOR(S) : Blažek

It is certified that error appears in the above-identified patent and that said Letters Patent is hereby corrected as shown below:

Column 1,
Line 35, “eyed” should read -- eliminated --
Line 40, “used It” should read -- used. It --

Column 2,
Line 6, “for do” should read -- for the --

Signed and Sealed this

First Day of June, 2004

JON W. DUDAS
*Acting Director of the United States Patent and Trademark Office*

US006488034C1

(12) EX PARTE REEXAMINATION CERTIFICATE (9396th)

United States Patent
Blazek

(10) Number: US 6,488,034 C1
(45) Certificate Issued: Nov. 5, 2012

(54) FILE, PARTICULARLY NAIL FILE

(75) Inventor: Dalibor Blazek, Podebrady (CZ)

(73) Assignee: J. Blazek Sklo Podebrady, S.R.O., Podebrady (CS)

Reexamination Request:
No. 90/011,944, Nov. 14, 2011

Reexamination Certificate for:

| | |
|---|---|
| Patent No.: | **6,488,034** |
| Issued: | **Dec. 3, 2002** |
| Appl. No.: | **09/254,578** |
| Filed: | **Apr. 14, 1999** |

Certificate of Correction issued Jun. 24, 2003.
Certificate of Correction issued Jun. 1, 2004.

(21) Appl. No.: 90/011,944

(22) PCT Filed: Jul. 9, 1998

(86) PCT No.: PCT/CZ98/00030

§ 371 (c)(1),
(2), (4) Date: Apr. 14, 1999

(87) PCT Pub. No.: WO99/02064

PCT Pub. Date: Jan. 21, 1999

(30) Foreign Application Priority Data

Jul. 10, 1997 (CZ) ..... PUV693697

(51) Int. Cl.

| | |
|---|---|
| ***A45D 29/00*** | (2006.01) |
| ***A45D 29/04*** | (2006.01) |
| ***A45D 29/18*** | (2006.01) |

(52) U.S. Cl. ..... 132/76.4; 132/76.5

(58) Field of Classification Search ..... None
See application file for complete search history.

(56) References Cited

To view the complete listing of prior art documents cited during the proceeding for Reexamination Control Number 90/011,944, please refer to the USPTO's public Patent Application Information Retrieval (PAIR) system under the Display References tab.

*Primary Examiner* — Catherine S. Williams

(57) ABSTRACT

The file, the body of which is provided on at least part of its surface with a roughness varying from 10 to 100 μm, is made of flat, pressed or hardened glass. The file can have a variety of geometrical shapes and cross sections.

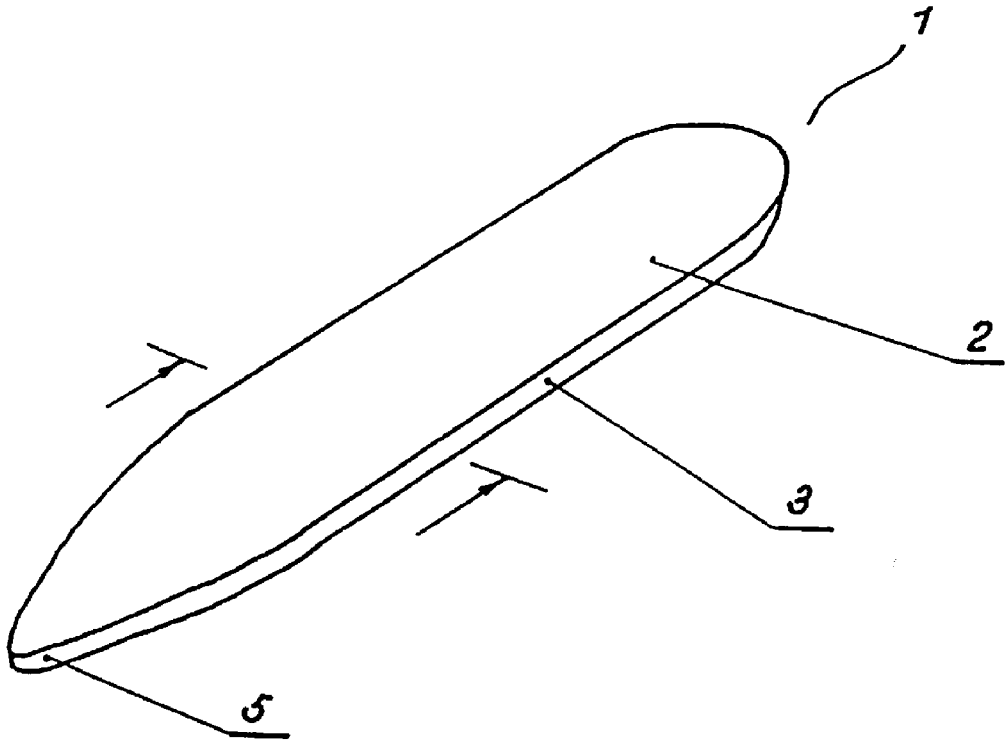

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-20 is confirmed.

* * * * *